United States Patent [19]

Moore

[11] Patent Number: 5,018,985

[45] Date of Patent: May 28, 1991

[54] CONNECTOR WITH MODULAR TERMINAL DEVICES

[75] Inventor: John R. Moore, Tustin, Calif.

[73] Assignee: ITT Corporation, New York, N.Y.

[21] Appl. No.: 396,252

[22] Filed: Aug. 21, 1989

[51] Int. Cl.[5] ..... H01R 29/00

[52] U.S. Cl. ..... 439/174; 29/883; 29/884; 439/518; 439/640

[58] Field of Search ..... 439/52, 151, 166, 170–175, 439/189, 518, 598, 599, 638–640, 713, 736, 869; 29/883, 884

[56] References Cited

U.S. PATENT DOCUMENTS

| | | | |
|---|---|---|---|
| 2,557,818 | 6/1951 | Eddy | 439/518 |
| 3,090,027 | 5/1963 | Phillips et al. | 439/518 |
| 3,594,696 | 7/1971 | Witek | 439/736 X |
| 3,978,581 | 9/1976 | Miura | 29/630 |
| 4,484,792 | 11/1984 | Tengler et al. | 339/143 |
| 4,639,056 | 1/1987 | Lindeman et al. | 339/17 |
| 4,686,766 | 8/1987 | Dubbs et al. | 29/883 |
| 4,712,299 | 12/1987 | Loewen et al. | 29/882 |

FOREIGN PATENT DOCUMENTS

| | | | |
|---|---|---|---|
| 1380706 | 1/1975 | United Kingdom | 439/736 |

*Primary Examiner*—Eugene F. Desmond
*Attorney, Agent, or Firm*—Thomas L. Peterson

[57] ABSTRACT

A connector is described of the type that has contacts lying in insulative material in a housing, wherein a separate positioner (24 in FIG. 2) of insulative material is molded about each contact (22) to form a terminal device (20), and the terminal devices can be arranged in a variety of configurations. Each terminal device includes an elongated metal contact with front and rear end portions and a middle, and an insulative positioner (24) molded about the middle. The terminal devices lie in the housing with the molded positioners of adjacent contact devices substantially abutting each other and holding the contact ends in a predetermined pattern, wherein the axes of all terminal devices extend parallel to each other. The middles of the contacts are hollow and include access openings (52 in FIG. 5) into which molding material can flow, so the molded material of the positioner seals the middle of the inside of each contact. The positioners are preferably of triangular cross section, as seen along an axis of the contact, and are positioned in a row with the flat sides (71) of alternate contacts lying in a common plane and with an apex (76) of a positioner therebetween lying on that plane.

5 Claims, 3 Drawing Sheets

FIG. 4
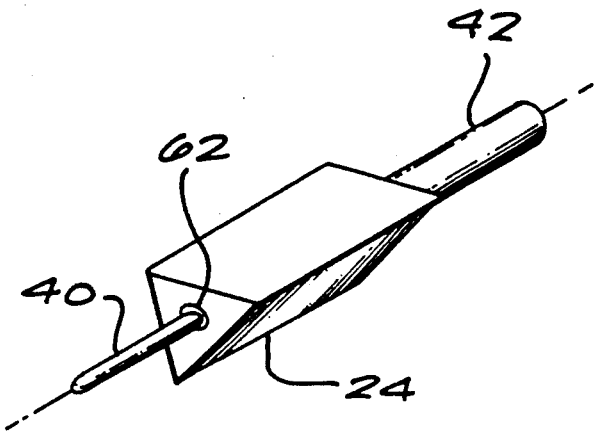
FIG. 6
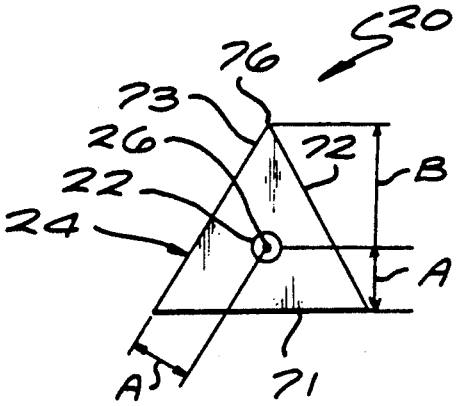
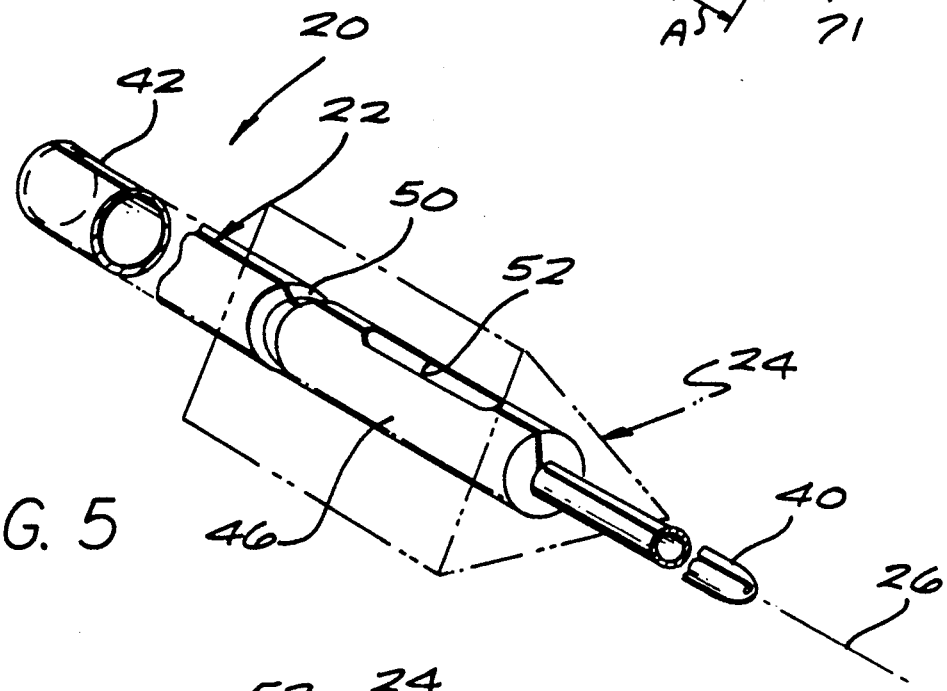
FIG. 5
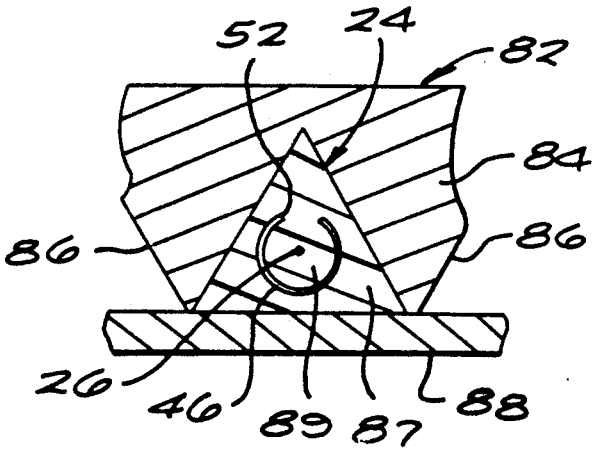
FIG. 8

FIG. 7
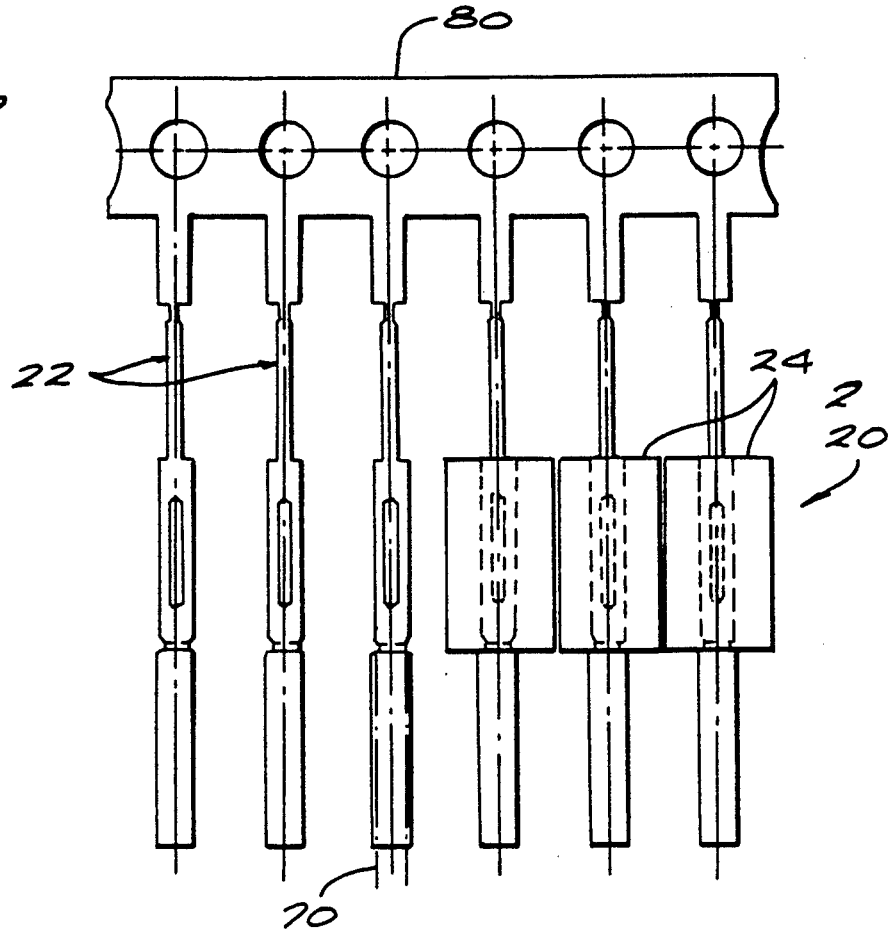
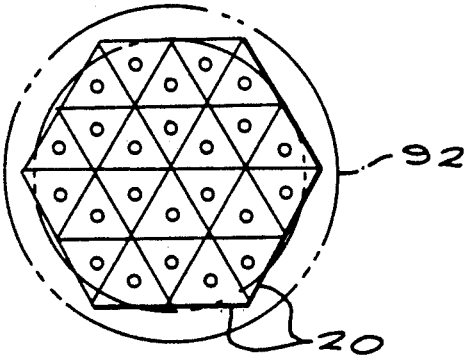
FIG. 9
FIG. 10
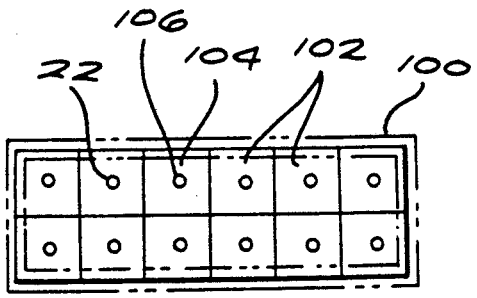

CONNECTOR WITH MODULAR TERMINAL DEVICES

BACKGROUND OF THE INVENTION

Multi-terminal contacts usually includes a block of insulative material having numerous parallel holes that hold metal contacts. The insulative block is usually molded and then the individual metal contacts are inserted into the holes of the block, although the insulative block can be molded directly around the multiple metal contacts. For each shape of connector, a different insulative block must be formed. A connector arrangement wherein the contacts and insulation around them were constructed to enable the contacts to be arranged in numerous configurations without the need to form a separate insulative block to closely hold the contacts and insulate them from each other, would be of considerable value.

SUMMARY OF THE INVENTION

In accordance with one embodiment of the present invention, a connector and terminal devices therefor are provided, which facilitate the custom arrangement and mounting of contacts. A connector includes a housing and a plurality of elongated terminal devices mounted therein. Each terminal device includes an elongated metal contact with front and rear end portions and a middle, and an insulative positioner molded about a portion of the contact, such as its middle. The terminal devices lie in the housing with their axes parallel to each other and with the molded positioners of adjacent contact devices substantially abutting each other to determine the relative positions of the contacts.

The positioners can be of triangular shape, having the cross section of an isosceles triangle and preferably of an equilateral isosceles triangle. The metal contacts can be formed of sheet metal with a largely cylindrical hollow middle portion. The cylindrical middle portion has an access opening therein, so as the plastic positioner is molded around the middle of a contact, some of the plastic flows through the access opening to seal the inside of the middle of the contact.

The novel features of the invention are set forth with particularity in the appended claims. The invention will be best understood from the following description when read in conjunction with the accompanying drawings.

BRIEF DESCRIPTION OF THE DRAWINGS

FIG. 4 is a perspective view of a terminal device of the connector of FIG. 3.

FIG. 5 is a perspective view of the terminal device of FIG. 4, with the positioner shown in phantom lines.

FIG. 6 is a front elevation view of the terminal device of FIG. 4.

FIG. 7 is a plan view of a strip containing finished terminal devices, and also containing contacts prior to molding of positioners thereabout.

FIG. 8 is a sectional view of a terminal device of FIG. 7, showing it in a mold.

FIG. 9 is a front elevation view of a portion of a connector constructed in accordance with another embodiment of the invention.

FIG. 10 is a front elevation view of a portion of a connector constructed in accordance with another embodiment of the invention.

DESCRIPTION OF THE PREFERRED EMBODIMENTS

Figure 1:
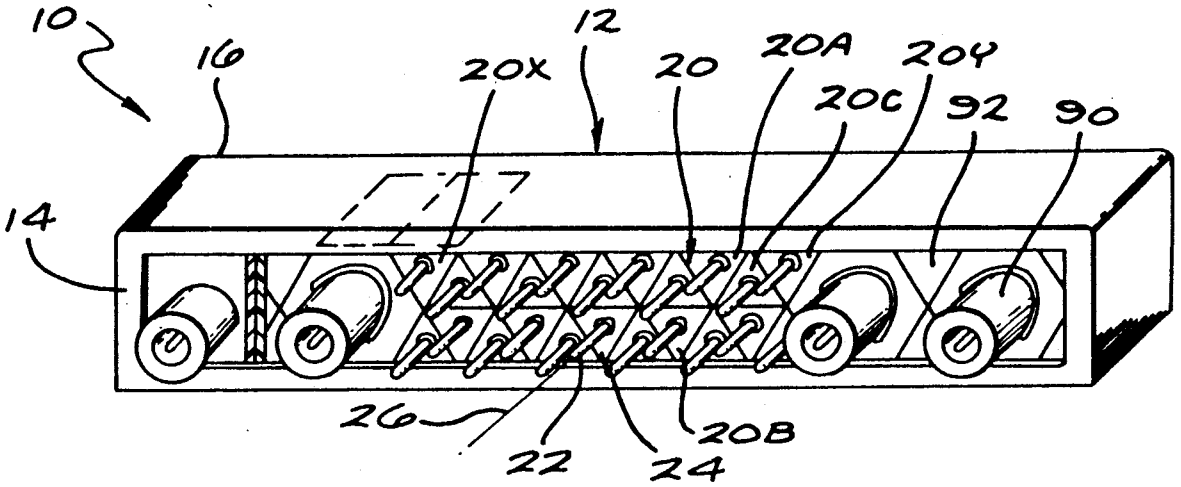
FIG. 1 is a front perspective view of a connector constructed in accordance with one embodiment of the present invention.
Figure 2:
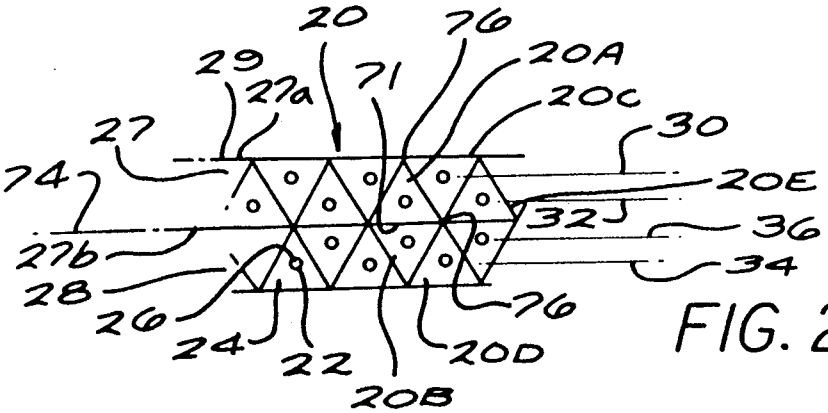
FIG. 2 is a front elevation view of a portion of the connector of FIG. 1, with some of the plates shown in cross-section.

FIG. 1 illustrates a connector 10 with a housing 12 having front and rear portions 14, 16. Several groups of terminal devices 20 are positioned in the housing, each having a metal contact 22 and an insulative positioner 24 around it. The positioners 24 have a cross sectional view, as viewed along the axis 26 of a terminal device, which is an isosceles triangle, and preferably an equilateral triangle. As shown in FIG. 2, the axis 26 of each terminal device lies on the axis of the contact 22 thereof. In the particular contact 10, the terminal devices are arranged in two rows 27, 28, with the terminal devices 20 of each row positioned to place the contacts along two contact row lines or rows 30, 32 or 34, 36. Each row has first and second opposite row sides such as **27*a*, 27*b* lying on imaginary planes 29, 74**.

FIG. 5 shows the construction of each contact 22 of a terminal device 20. The contact is formed of sheet metal that has been bent and deformed as shown in the figure. The contact has front and rear end portions 40, 42 and a middle 46. The sheet metal of the contact has been bent to form hollow cylinders of different diameters along the different contact portions. The rear portion and middle are of the same diameter, but include a reduced diameter portion 50, while the front end portion 40 is of a smaller diameter. After the contact has been formed, the positioner 24 is molded to the middle of the contact. The middle contact portion includes an access opening 52 that allows molding material to flow into the hollow cylinder formed at the middle, to seal the middle of the hollow contact so moisture cannot pass through it.

Figure 3:
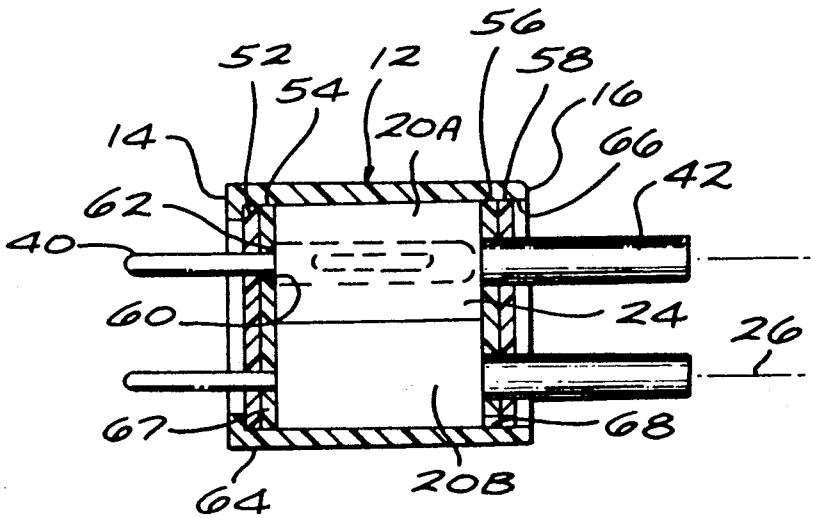
FIG. 3 is a sectional side view of the connector of FIG. 1.

FIG. 3 shows the assembled connector, showing two terminal devices 20A and 20B. The housing 12 of the connector includes front plates 52, 54 and rear plates 56, 58. The plates 54, 56 are formed of rubber and serve to seal out moisture. However, the front plate 54 has locating recesses 60 into which projections 62 on the positioner 24 can snap. The front and rear ends 67, 68 of each positioner abut the plates of the housing, to fix the positions of the terminal devices along their axes, so the ends of all of the positioners 24 are coplanar. A front retainer plate 52 of more rigid material than the rubber seal plate 54, more securely retains the parts in a connector shell 64. The terminal devices and plates are held in the shell 64 with openings at its front and rear ends. The rear retainer plate 58 can snap through a rear opening 66 of the shell to lock in the other components after they have been slid into the shell. As with other connectors of this type, the front end portions 40 of the contacts are positioned to mate with contacts of another connector, while the rear end portions are usually connected to wires, although they can be connected to other contacts. The positions of the front plates 52, 54 can be reversed, so the elastomeric plate 54 is frontmost to seal to the face of a mating connector.

As shown in FIG. 6, the terminal device is constructed so its axis 26 and the axis of the contact 22 thereof are located at the center of the equilateral triangle shape of the outside of the positioner 24. This results in the distance A of the axis 26 from each of the three sides 71–73 of the triangle being equal. However, the distance B between the axis 26 at each apex 76 of the triangle is greater than the distance A. As is shown in FIG. 2, alternate terminal devices 20A, 20C along a row are oriented upside-down from each other, in that the apex 76 of device 20A is uppermost, while the apex of the adjacent device 20C is lowermost. Another way of stating this is that sides 71 of alternate terminal devices 20A, 20E of a row lie in a common plane 74, while an apex 76 of a device 20C between them also lies on that plane. Two terminal devices 20A, 20B lying one over another, have adjacent sides 71 in facewise contact, while the next devices 20C, 20D lying over one another have their apexes 76 adjacent to each other. This results in the contacts lying in four rows 30–36 in the connector of FIGS. 1 and 2. Substantially the entire volume or space between the positioners 24 of a pair of end terminal devices 20X, 20Y lying at the ends of a row, is occupied by the positioners of intermediate terminal devices such as 20A, 20C of that row (and the middle contact portions in the positioners).

FIG. 7 shows contacts 22 on a carrier strip 80 formed of the same sheet of metal from which the contacts were formed, as is commonly practiced in the industry. FIG. 7 also shows positioners 24 that have been molded around the middle of some contacts. FIG. 8 shows a positioner 24 in a mold 82 that includes an upper plate 82 forming multiple cavities 86, and a lower plate 88. The middle 46 of the contact is shown. A group of perhaps ten or twenty of the contacts on the carrier strip 80 can be placed in the multiple-cavity mold 82 and plastic material injected into the cavities to surround the contact and fill the inside of the middle 46 of each contact. Thus, each positioner includes an outside portion 87 around the contact and an inside portion 89 inside the hollow cylindrical contact portion and connected to the outside portion through the access hole. The rear end portion 42 of each contact of the particular type shown is used as a socket to receive a pin. A molding rod 20 (FIG. 7) is inserted into the rear portion of the contact to prevent molding material from filling the rear portion of the contact, and also to help hold the contact in position in the mold. It may be noted that it does not matter if the front portion of the contact is filled with molding material, although stops can be used in the mold to prevent this if desired. The carrier strip is advanced after a positioner 24 has been molded about each of a group of contacts. The carrier strip can then be used to carry the terminal devices to a location where they are severed from the carrier strip and placed, as in FIG. 1, in a connector housing 12.

In the connector housing 12, the positioners substantially abut each other and hold the front and rear ends of the contacts in a predetermined pattern of spacing, the particular pattern of FIG. 1 holding the contacts in four parallel rows. Where desired, an adhesive may be placed about the positioners to fix them together, although this is generally not required. It may be noted that in FIG. 1, the connector includes coaxial contacts 90 in large positioners 92 having hexagonal peripheries and having a height equal to the height of two triangular positioners. The hexagonal shape of positioners 92 is useful in that each occupies the space of six triangular positioners 24. The positioner 92 can be used to hold optical fiber connectors or high current power connectors. The connector also includes dummy positioners 92 of the same shape as the positioners of the terminal devices, but which do not hold a contact and which are used to occupy otherwise empty space in the connector and to hold the other positioners in alignment.

FIG. 9 illustrates the terminal devices 20 in another arrangement useful for mounting in a circular shell 96.

Thus, the invention provides terminal devices that can be arranged in a pattern within a housing to form connectors of a variety of sizes and shapes. Each terminal device includes a metal contact with opposite end portions and a middle, and a positioner molded intimately to at least the middle of the contact (the positioner may also be molded to one or both end portions). The periphery of the terminals form cross sections (as seen along the axis of the contacts) that are of regular shape, and which are of triangular (isosceles, preferably equilateral) or rectangular shape. The positioners substantially abut each other (with possibly a plating for RF shielding or a bonding agent between them) and fix the relative positions of the contacts so their front and rear ends lie in a predetermined pattern. Where the contacts are formed with hollow cylindrical middle portions, the middle portion is formed with an access opening through which molding material passes so the molding material of the positioner also seals the middle of the contact.

Although particular embodiments of the invention have been described and illustrated herein, it is recognized that modifications and variations may readily occur to those skilled in the art and consequently it is intended to cover such modifications and equivalents.

What is claimed is:

1. A connector comprising:

a plurality of terminal devices, each including an elongated contact having an axis, and each including a quantity of insulative material forming a positioner, each of said positioners molded to and surrounding a portion of the corresponding contact and having a periphery formed of a plurality of flat sides and with said periphery being of substantially constant size and shape along the axis of the contact, each of said plurality of positioners being separate from the other ones of said positioners;

a housing, said positioners of said terminal devices lying in said housing, with their peripheries substantially abutting each other and with said contact axes extending parallel to each other.

2. In a connector which includes a housing and contacts in the housing for mating with those of another connector, the improvement comprising:

a plurality of terminal devices, each having an axis, each having an elongated metal contact with front and rear end portions spaced along said axis and a middle portion, and each having its own insulative positioner molded to and about the middle of the contact;

the positioners of said terminal devices lying in said housing with the axes of said devices extending parallel to each other, and with the molded positioners of adjacent contact devices substantially abutting each other and holding said front and rear ends of said contacts in a predetermined pattern;

said positioners each have front and rear ends, and said housing has front and rear portions respectively abutting said positioner front and rear ends, to fix the positions of said contacts along their axes.

3. In a connector which includes a housing and contacts in the housing for mating with those of another connector, the improvement comprising:

a plurality of terminal devices, each having an axis, each having an elongated metal contact with front and rear end portions spaced along said axis and a middle portion, and each having its own insulative positioner molded to and about the middle of the contact;

the positioners of said terminal devices lying in said housing with the axes of said devices extending parallel to each other, and with the molded positions of adjacent contact devices substantially abutting each other and holding said front and rear ends of said contacts in a predetermined pattern;

each of said positioners has a substantially uniform cross section of an isosceles triangle, and said terminal devices are arranged in at least two rows with a side of each triangle of alternate positioners in a row lying in the same imaginary plane, and with an apex of a triangle of a positioner lying between a pair of alternate positioners, lying in said plane;

at least one large positioner of hexagonal cross section, occupying the space of six of said triangular positioners and having sides abutting triangular positioners in said two rows.

4. In a connector which includes a housing and contacts in the housing for mating with those of another connector, the improvement comprising:

a plurality of terminal devices, each having an axis, each having an elongated metal contact with front and rear end portions spaced along said axis and a middle portion, and each having its own insulative positioner molded to and about the middle of the contact;

the positioners of said terminal devices lying in said housing with the axes of said devices extending parallel to each other, and with the molded positioners of adjacent contact devices substantially abutting each other and holding said front and rear ends of said contacts in a predetermined pattern;

said middle portion of each of said metal contacts has a largely cylindrical shape with a hollow inside, and also has an access hole leading from outside said contact to said hollow inside, and each of said positioners includes an inside portion lying in and sealing said hollow inside and another portion lying around said middle portion and with said positioner portions connected through said access hole.

5. In the manufacture of a connector by placing insulative material in a housing, and placing at least the middle portions of a plurality of elongated metal contacts in the insulative material, but with front and rear ends of the contacts accessible from the front and rear ends of the housing, the improvement comprising:

forming a metal strip into a multiplicity of said contacts having ends joined to a common carrier strip;

placing a plurality of said contacts at a time, while they remain joined to said carrier strip, in a mold with a corresponding plurality of cavities, and molding a separate quantity of insulative material around at least said middle portion of each of said contacts to form terminal devices that each includes an elongated contact having an axis and an insulative positioner around the contact, and removing said terminal devices from said mold while said contact ends remain joined to said carrier strip, and placing said terminal devices in said housing with said contact axes extending parallel to each other, and with said positioners substantially abutting one another to fix the relative positions and spacing of said contacts.

* * * * *